US011414908B2

(12) United States Patent
Salice

(10) Patent No.: US 11,414,908 B2
(45) Date of Patent: Aug. 16, 2022

(54) DECELERATED HINGE FOR FURNITURE

(71) Applicant: ARTURO SALICE S.P.A., Novedrate (IT)

(72) Inventor: Sergio Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 0 days.

(21) Appl. No.: 17/254,436

(22) PCT Filed: May 14, 2019

(86) PCT No.: PCT/EP2019/062359
§ 371 (c)(1),
(2) Date: Dec. 21, 2020

(87) PCT Pub. No.: WO2019/242942
PCT Pub. Date: Dec. 26, 2019

(65) Prior Publication Data

US 2021/0270071 A1 Sep. 2, 2021

(30) Foreign Application Priority Data

Jun. 22, 2018 (IT) ..... 102018000006575

(51) Int. Cl.
*E05F 1/08* (2006.01)
*E05F 5/00* (2017.01)
*E05D 3/16* (2006.01)

(52) U.S. Cl.
CPC ..... *E05F 5/006* (2013.01); *E05D 3/16* (2013.01); *E05Y 2201/21* (2013.01);
(Continued)

(58) Field of Classification Search
CPC ..... E05Y 2900/20; E05Y 2900/202; E05Y 2900/204; E05Y 2900/208; E05Y 2201/25;
(Continued)

(56) References Cited

U.S. PATENT DOCUMENTS 5,058,238 A * 10/1991 Lautenschlager ..... E05D 3/16 16/278
9,115,525 B2 * 8/2015 Zimmer ..... E05F 5/08
(Continued)

FOREIGN PATENT DOCUMENTS

CN 203856311 U 10/2014
CN 106103873 A 11/2016
(Continued)

OTHER PUBLICATIONS

International Search Report and Written Opinion dated Jul. 29, 2019 issued in PCT/EP2019/062359.
(Continued)

*Primary Examiner* — Chuck Y Mah
(74) *Attorney, Agent, or Firm* — Scully, Scott, Murphy & Presser, P.C.

(57) ABSTRACT

A decelerated hinge for supporting, so as to oscillate, a door of an item of furniture, which comprises a first hinge part which can be affixed to a fixed part of the item of furniture, a second hinge part which can be affixed to a door of the item of furniture and connected to the first hinge part by way of an articulation system which comprises a plurality of connecting levers and at least five articulation axes, and a deceleration device which comprises an actuating member that is moveably arranged in a first connecting lever of the articulation system, and at least one actuation surface for the actuating member of the deceleration device is provided
(Continued)

inside a second connecting lever which is adjacent to the first connecting lever of the articulation system.

15 Claims, 5 Drawing Sheets

(52) U.S. Cl.
CPC ..... *E05Y 2201/41* (2013.01); *E05Y 2201/422* (2013.01); *E05Y 2201/474* (2013.01); *E05Y 2900/20* (2013.01)

(58) Field of Classification Search
CPC ..... E05Y 2201/26; E05Y 2201/626; E05Y 2201/20; E05Y 2201/21; E05Y 2201/261; E05Y 2201/41; E05Y 2201/422; E05Y 2201/474; E05Y 2600/53; E05F 5/006; E05F 5/02; E05F 5/027; E05D 11/1021; E05D 11/1042; E05D 11/105; E05D 11/1064; E05D 7/04; E05D 7/0407; E05D 3/16; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 9,528,307 | B2 * | 12/2016 | Rohner | E05D 3/12 |
| 2007/0251058 | A1 * | 11/2007 | Fitz | E05D 3/16 16/287 |
| 2008/0168620 | A1 * | 7/2008 | Hammerle | E05F 5/006 16/85 |
| 2015/0330128 | A1 * | 11/2015 | Ng | E05D 7/0407 16/65 |
| 2016/0153224 | A1 * | 6/2016 | Salice | E05F 3/20 16/52 |
| 2016/0333620 | A1 * | 11/2016 | Holzapfel | A47B 96/00 |
| 2017/0138106 | A1 * | 5/2017 | Stuke | E05D 11/1021 |
| 2018/0087307 | A1 * | 3/2018 | Hammerer | E05F 5/006 |
| 2019/0383081 | A1 * | 12/2019 | Thielmann | E05D 11/0054 |
| 2021/0010311 | A1 * | 1/2021 | Nordieker | E05F 3/18 |

FOREIGN PATENT DOCUMENTS

| | | | | |
|---|---|---|---|---|
| CN | 107002442 | A | | 8/2017 |
| CN | 107288457 | A | | 10/2017 |
| CN | 107750297 | A | | 3/2018 |
| CN | 107810304 | A | | 3/2018 |
| DE | 2836020 | A | * | 3/1979 |
| EP | 1809843 | B1 | | 2/2008 |
| JP | 2010209638 | A | * | 9/2010 |
| WO | WO 2006/053364 | A1 | | 5/2006 |
| WO | WO 2011/095323 | A1 | | 8/2011 |
| WO | WO 2015/135005 | A1 | | 9/2015 |
| WO | WO 2016/201462 | A1 | | 12/2016 |

OTHER PUBLICATIONS

Italian Search Report and Written Opinion dated Feb. 15, 2019 issued in IT 201800006575.
Chinese Office Action and Search Report dated Dec. 7, 2021 received in Chinese Application No. 2019800414879, together with an English-language translation.

* cited by examiner

DECELERATED HINGE FOR FURNITURE

BACKGROUND OF THE DISCLOSURE

The invention relates to a decelerated hinge for doors of furniture or the like, in particular a hinge of the type with a wide opening angle which has an articulation system that comprises seven articulation axes, and which is provided with a deceleration device that is adapted to decelerate the closing movement of the hinge.

In the furniture sector, items of furniture are commonly made which have doors that are supported, so as to oscillate, by hinges that comprise a fixed part which can be connected to the body of the item of furniture and a moveable part, constituted by a box, which can be connected to the door, such parts being mutually articulated so as to oscillate, for example by way of an articulation system that comprises a plurality of connecting levers.

The hinges likewise comprise adapted elastic means, for example flat springs or wire springs, in order to push the door in the closing direction.

However, owing to the presence of such elastic means, the door leaf, in the closed position, slams against the body of the item of furniture with force, causing unwanted noise.

In order to overcome such problem, it has been variously proposed to adopt deceleration devices, for example associated with one of the parts of the hinge, in order to damp the closing movement of the hinge, and such devices can be of the linear type or of the rotating type and use a fluid or a grease as braking means.

For example, a deceleration device of the grease-operated rotary type is known from EP 1809843, and is in the form of an assembly that can be mounted on an external side of the bottom and side walls of the moveable part of the hinge; such device uses a deceleration disk which can be actuated by means of a slider and a cam that is integral with one of the connecting levers of the hinge.

However, applying the deceleration device externally to the box of the hinge entails an increase in the overall height of the box, preventing its use on doors of reduced thickness.

In order to overcome such limitation, in hinges with an articulation system that comprises four connecting levers and seven articulation axes, for example in WO 2011/095323, it has been proposed the use of a deceleration device of the fluid-operated linear type in the fixed part of the hinge, such device being actuated by an extra oscillating lever in addition to those of the articulation system; in particular such extra lever is supported so as to oscillate by the fixed part of the hinge and has a first end which is connected by adapted means to the linear damper and a second end which comes into contact with one of the levers of the articulation system along part of the closing movement of the hinge, in order to actuate the damper.

Such solution however, owing to the presence of the additional lever and of the corresponding means for connection with the damper, is complex from the point of view of construction and assembly.

Also known for such type of hinges, for example from WO 2006/053364, is the use of a linear deceleration device on the back of an intermediate lever of the articulation system, such lever being supported so as to oscillate with respect to the part connected to the item of furniture by way of another two levers of that system; by virtue of such arrangement, the actuation of the linear damper can come about by way of the thrust exerted on a movable element of the damper by one of the connecting levers of the system which is adjacent to the aforementioned intermediate lever, or by a part that is integral with the door of the item of furniture.

Such a solution however entails an increase in the space occupation of the hinge inside the item of furniture, owing to the positioning of the deceleration device on one of the intermediate levers of the articulation system; furthermore, it cannot be applied to all types of hinges that have seven articulation axes.

Therefore there is a need to be able to apply a deceleration device to a hinge in a simple manner, having at the same time small space occupation and retaining optimal operation in the braking phase.

BRIEF SUMMARY OF THE DISCLOSURE

The principal aim of the present invention is therefore to provide a hinge for doors of furniture or the like that is provided with a linear deceleration device, which is simple in construction and which is suitably configured to provide an effective decelerating action.

Within this aim, an object of the present invention is to provide a hinge for doors of items of furniture or the like that has a deceleration device of the linear type, has a reduced space occupation inside the item of furniture, comparable to that of a non-decelerated hinge, and which has a moveable part of reduced height so as to permit its use even on doors of reduced thickness.

Another object of the present invention is to provide a hinge for doors of furniture or the like that is highly reliable, easily and practically implemented and of low cost.

This aim and these and other objects which will become better apparent hereinafter are achieved by a decelerated hinge for supporting, so as to oscillate, a door of an item of furniture or the like, which comprises:

- a first hinge part which can be affixed to a fixed part of the item of furniture;
- a second hinge part which can be affixed to a door of the item of furniture and connected to the first hinge part by way of an articulation system which comprises a plurality of connecting levers and at least five articulation axes;
- elastic means that act in the closing direction of the hinge; and
- a deceleration device which comprises an actuating member that can move linearly according to an axis, characterized in that said actuating member of the deceleration device is moveably arranged in a first connecting lever which is selected from among said plurality of connecting levers of the articulation system, and in that at least one actuation surface for the actuating member of said deceleration device is provided inside a second connecting lever which is adjacent to said first connecting lever of the articulation system.

Further characteristics of the present invention are further defined in the dependent claims.

BRIEF SUMMARY OF THE SEVERAL VIEWS OF THE DRAWINGS

The characteristics and the advantages of the present invention will become better apparent from the following description of some preferential, but non-limiting, embodiments of the hinge with deceleration device for furniture, with reference to the accompanying drawings wherein.

DETAILED DESCRIPTION OF THE DISCLOSURE

Figure 1:
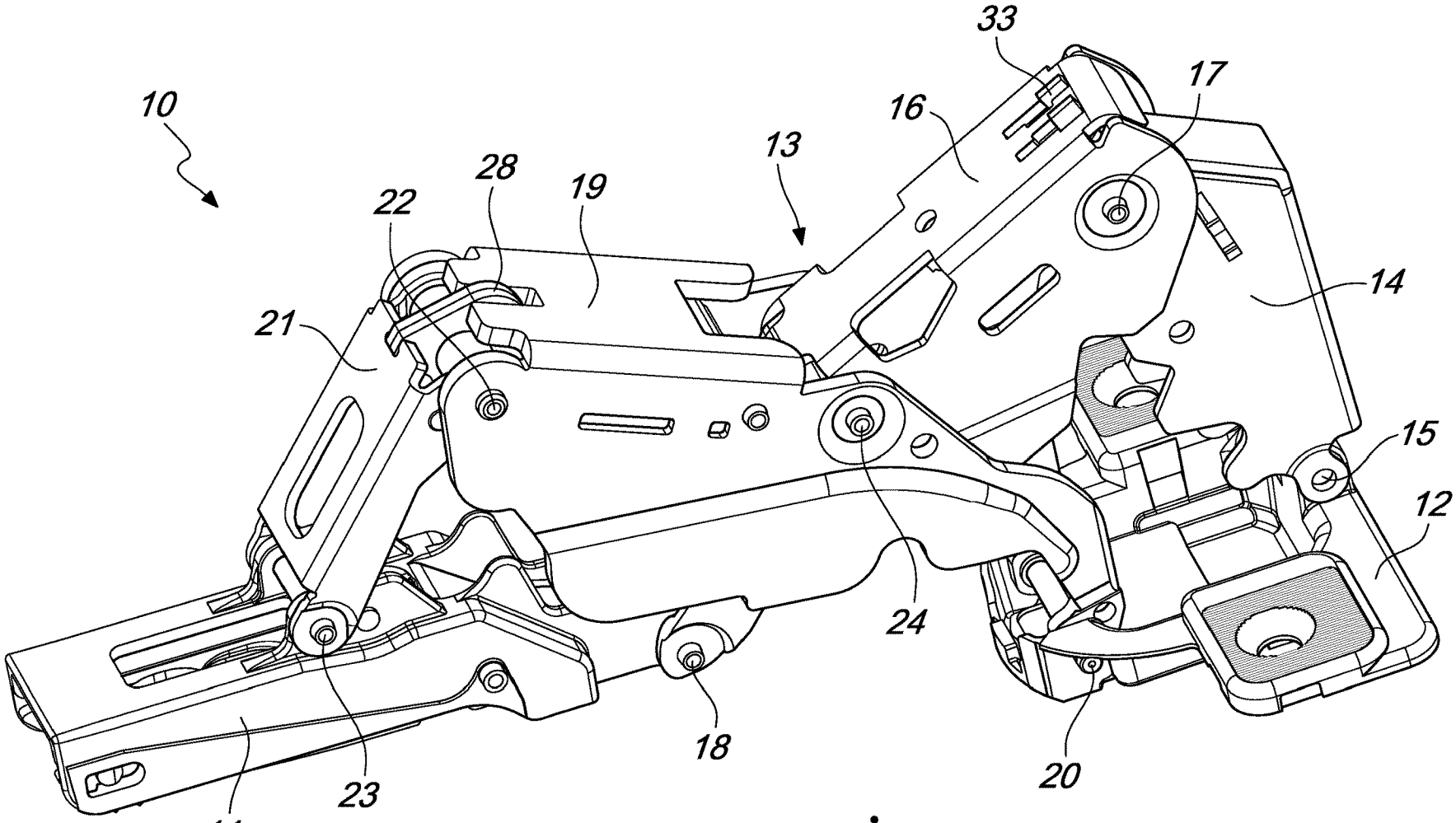
FIG. 1 is a perspective view of the hinge according to a first embodiment of the invention.

FIGS. 1 to 4 illustrate a hinge for supporting, so as to oscillate, a door of an item of furniture according to a first embodiment of the present invention, generally designated with the reference numeral 10; such hinge comprises a first hinge part or arm 11 which can be fixed to a side wall of the item of furniture or to another fixed part of the item of furniture through a separate conventional fixing base which can be applied to the side wall of the item of furniture.

The hinge 10 further comprises a second hinge part or box 12 which can be affixed to a movable element of the item of furniture, for example a door, and connected to the hinge arm 11 by way of an articulation system 13 that comprises a plurality of moveable connecting levers and at least five articulation axes in order to allow a wide movement of the hinge between an open position and a closed position for the door.

Preferably the articulation system 13 is of the type that comprises four connecting levers and seven articulation axes, which makes it possible to obtain wide open angles of doors, for example greater than or equal to 110°, as well as specific movements for the doors themselves, which are necessary for example in order to allow the opening of doors with particular shaped regions, or which are made of glass or the like.

In particular, such articulation system 13 comprises a first connecting lever 14 which has one end connected, so as to oscillate, to the box 12 by way of a first articulation axis 15; at the opposite end, the first connecting lever 14 is connected, so as to oscillate, to a second connecting lever 16, by means of a second articulation axis 17.

The second connecting lever 16 at the opposite end is connected, so as to oscillate, to the hinge arm 11 by way of a third axis 18 which is arranged at the front part of that arm which is directed toward the door of the item of furniture.

The system 13 further comprises a third connecting lever 19, which is articulated at one end with the box 12 by means of a fourth articulation axis 20 and at the opposite end with a fourth connecting lever 21 by way of a fifth articulation axis 22; the fourth connecting lever 21 is articulated with the arm 11 by way of a sixth articulation axis 23.

Finally, the second connecting lever 16 and the third connecting lever 19 are mutually articulated in an intermediate point thereof by way of a seventh articulation axis 24.

For the purposes of the present description, the first connecting lever 14 and the second connecting lever 16 are considered mutually adjacent, in that they are mutually articulated at one end by way of the articulation axis 17.

Similarly, the third connecting lever 19 and the fourth connecting lever 21 are considered mutually adjacent, in that they are mutually articulated at one end by means of the articulation axis 22.

The hinge 10 likewise comprises elastic means that act in the closing direction of the hinge, which preferably comprise a helical spring 25 mounted on the third connecting lever 19; such spring 25 presses a pusher 26 which has a roller 27 which is contoured to act on a cam 28 that is integral with the fourth connecting lever 21.

The hinge further comprises a deceleration device 29 which has an actuating member 30 that can move linearly according to an axis L.

According to the present invention, the actuating member 30 of the deceleration device 29 is arranged so that it can move in a first connecting lever of the articulation system which is chosen from the following connecting levers: 14, 16, 19, 21; furthermore, in the hinge according to the present invention there is an actuation surface 31 for the actuating member 30 of the deceleration device 29 placed inside a second connecting lever which is adjacent to the first connecting lever which is selected from among the aforementioned connecting levers 14, 16, 19, 21.

In particular, the actuating member 30 can be arranged in the first lever 14 of the system and the actuation surface 31 can be provided inside the second lever 16 of the system, adjacent to the first lever 14, or vice versa.

Alternatively, the actuating member 30 can be arranged in the third lever 19 of the system and the actuation surface 31 can be provided inside the fourth lever 21 of the system, adjacent to the third lever 19, or vice versa.

The actuating member 30 of the deceleration device 29 in general is not always in contact with the actuation surface 31, but it can rest on at least one contact point of the surface 31 in a neighborhood of the closed position of the hinge, for example starting from an open angle of the hinge of 30° up to the fully-closed position of the hinge, so that it will be pressed in order to generate the necessary decelerating action for the closing movement of the hinge.

Preferably the orthogonal to the actuation surface 31 in the at least one contact point extends substantially parallel to the axis L of the actuating member 30 or at the most inclined up to 25° in the aforementioned neighborhood of the closed position of the hinge; in this manner the achievable extension of the stroke of the actuating member 30 at this neighborhood of the closed position is maximized, making it possible to obtain an effective braking action of the closing movement of the hinge by the deceleration device 29.

Also for this purpose, preferably the axis L of the actuating member 30 of the deceleration device 29 is arranged substantially orthogonal to the longitudinal axis along which the first connecting lever extends.

In the preferred embodiment illustrated in the figures, the actuating member 30 is arranged in the first lever 14 of the system, while the actuation surface 31 is provided inside the second lever 16 of the system, adjacent to the first lever 14, or vice versa.

The actuation surface 31 can be provided directly in the second connecting lever 16 or on a separate actuation element 32 as in the case shown in the figures, for example in the form of a moveable plate.

In order to enable an adjustment of the decelerating action, preferably the actuation element 32 is moveably and adjustably supported in the or on the second connecting lever 16, for example slideably in a longitudinal or transverse direction in the second connecting lever 16 or rotatably therein.

Figure 3:
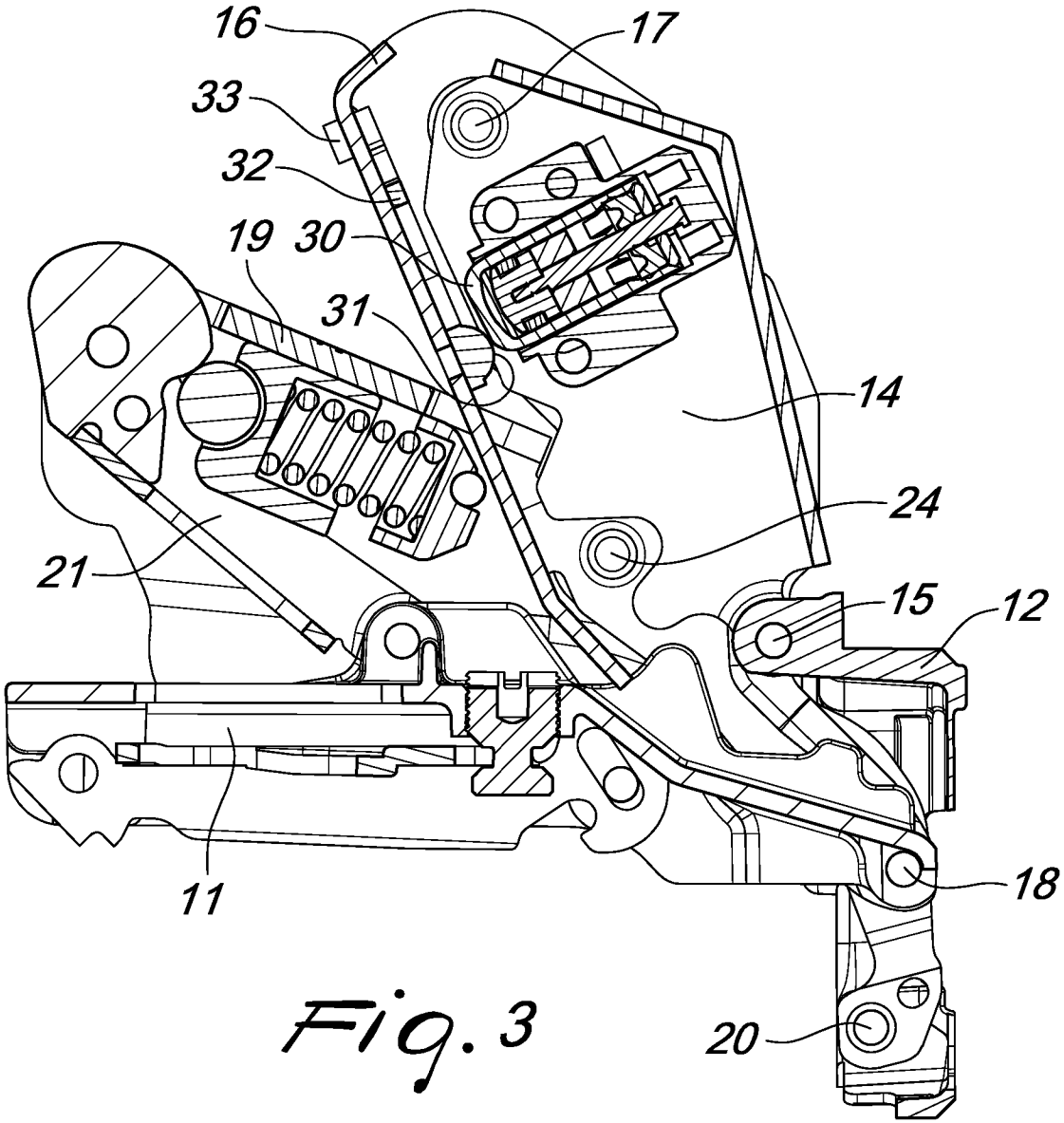
FIG. 3 is the cross-sectional view in FIG. 2, at the fully-closed angle of the hinge.
Figure 4:
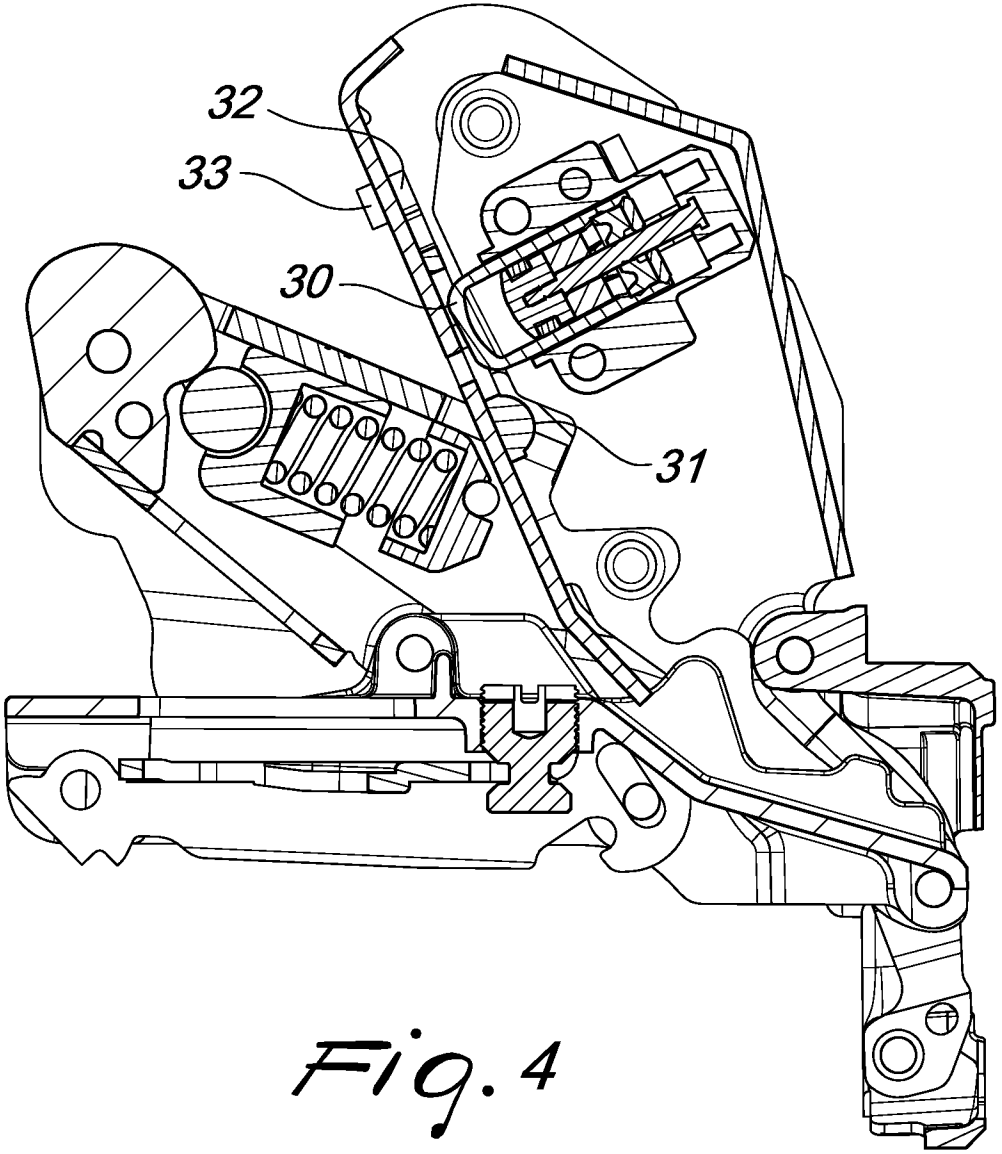
FIG. 4 is a longitudinal cross-sectional view of the hinge in FIG. 1 with the deceleration device at least partially deactivated, at the fully-closed angle of the hinge.
Figure 5:
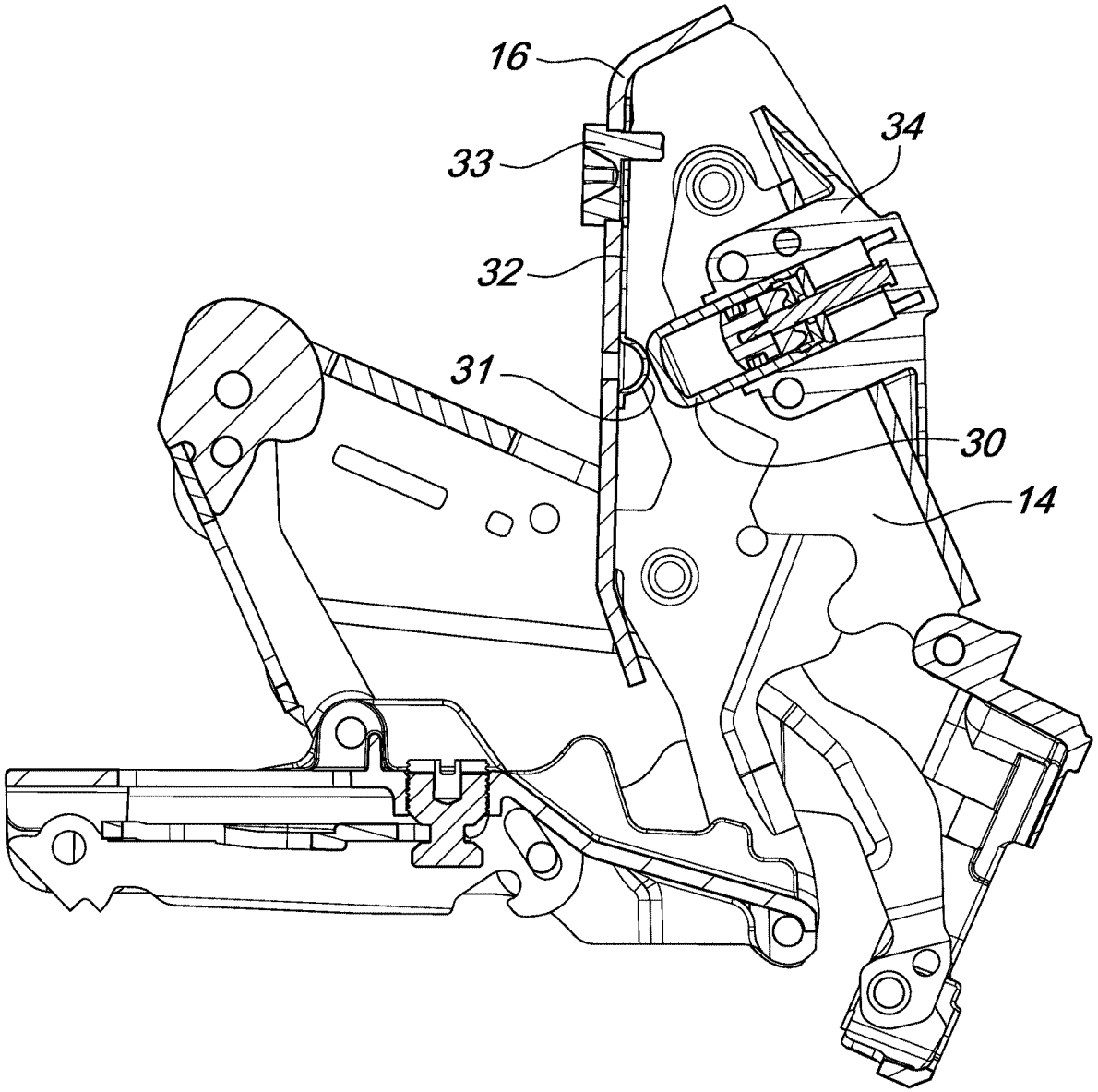
FIG. 5 is a longitudinal cross-sectional view of a second embodiment of the hinge according to the invention.

In order to drive the movement of the actuation element 32, there is an adjusting and/or locking member 33 which can be actuated by a user manually or using a tool; for example the adjusting and/or locking member 33 can be constituted by a part 33 of the actuation element 32 that extends on an external side of the second lever 16, as illustrated in the first embodiment in FIGS. 1 to 4, or by a separate element such as an eccentric element 33, as illustrated in the second embodiment in FIG. 5, or another rotatably or slideably movable element adapted to drive the movement and/or the locking of the actuation element 32 in different active positions such as to activate or deactivate, partially or completely, the decelerating action.

Figure 2:
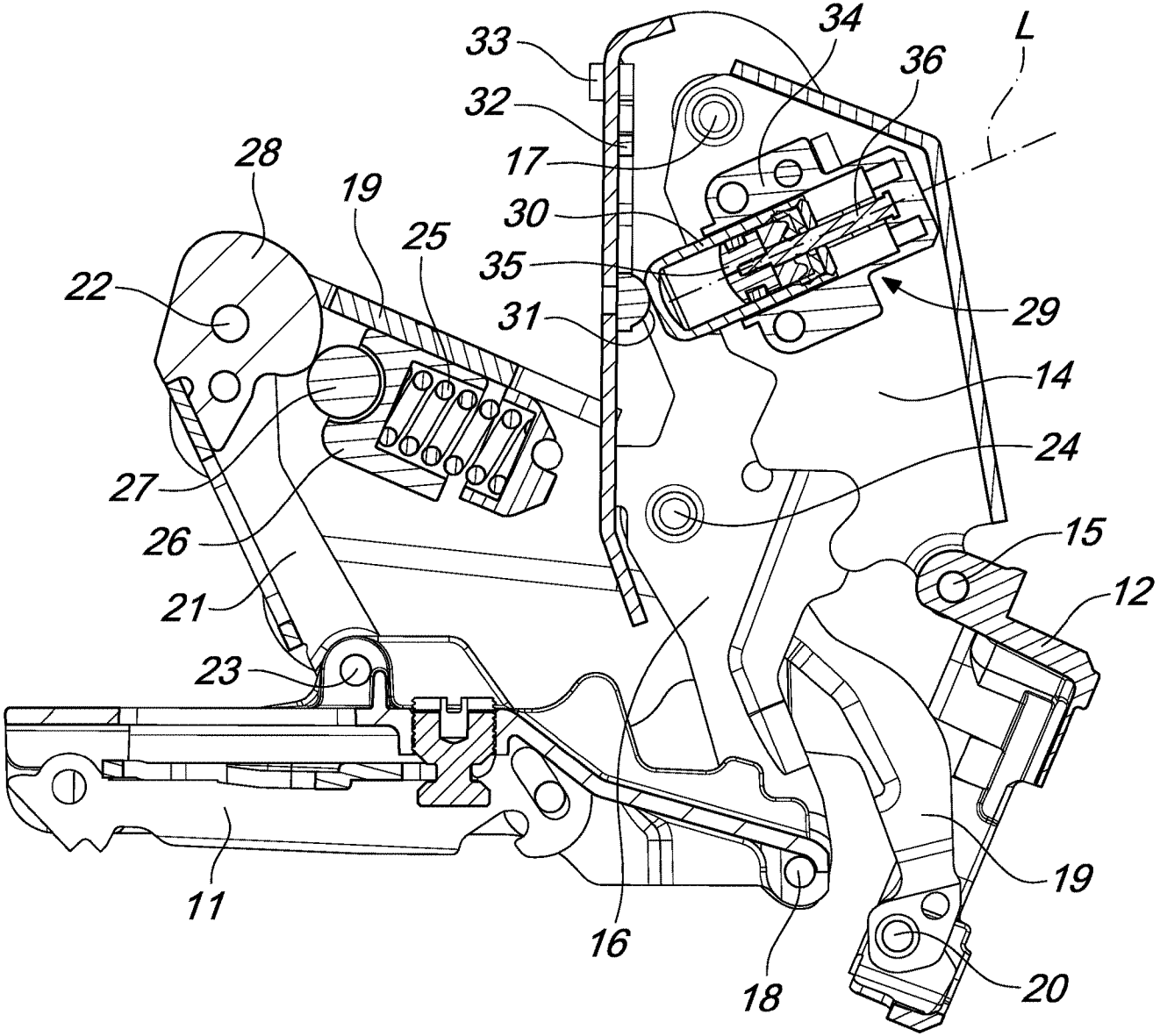
FIG. 2 is a longitudinal cross-sectional view of the hinge in FIG. 1 with the deceleration device activated, at an open angle of the hinge in which the deceleration device begins to carry out its function during the closing movement of the hinge.

In particular, in order to activate or maximize the decelerating action, the actuation element 32 is arranged in an advanced position toward the axis 17, in which the actuating member 30 of the damper comes into contact or anticipates contact with the surface 31 of the actuation element 32; such configuration of maximum deceleration is illustrated in FIGS. 1 to 3.

By contrast, in order to deactivate or minimize the decelerating action, the actuation element 32 is arranged in a retracted position toward the axis 24, in which the actuating member 30 of the damper does not come into contact or postpones contact with the surface 31 of the actuation element 32; such configuration of deactivated or minimum deceleration is illustrated in FIG. 4.

To adjust the decelerating action, as an alternative to or in combination with the movement of the actuation element 32, it is possible to have the deceleration device 29 both moveably supported as a whole in the first connecting lever 14, for example moveably axially along the axis L of the actuating member 30, preferably by way of screw means, or moveably rotatably or so as to oscillate inside the lever 14, so as to approach or distance the actuating member 30 to/from the actuation surface 31 in order to anticipate or postpone the braking.

In order to enable a modulation of the braking during the closing movement of the hinge, the actuation surface 31 and/or the actuating member 30 of the damper can likewise have cam-shaped contact surfaces.

In order to achieve an effective lever arm for actuating the deceleration device 29 by the second connecting lever 16, the axis L of the actuating member 30 of the deceleration device 29 lies preferably in the first connecting lever 14 at a distance from the second articulation axis 17 comprised between ⅕ and ⅗ of the overall distance between the first 15 and the second 17 articulation axis.

Preferably the first and the second connecting lever 14, 16 have U-shaped sections open on respective sides which are facing each other at the closed position of the hinge, so that the deceleration device 29 is enclosed and inserted in the levers 14, 16.

Similarly, the third connecting lever 19 and the fourth connecting lever 21 preferably have U-shaped sections open on respective sides which are facing each other at the closed position of the hinge.

In the preferred embodiment illustrated in the figures, the deceleration device 29 is provided with a housing body 34 which is contoured to be affixed in the first connecting lever 14 and which defines a cylindrical seat for sliding and/or guiding a linear damper which is fluid-operated, for example using oil, air or grease, which in turn comprises a cylinder 30 which defines a chamber for the fluid, in the specific case oil, in which a piston 35 with an annular sealing gasket can move slideably.

In the embodiment shown, the actuating member 30 of the deceleration device and the cylinder of the damper coincide or in any case they are made in a single piece; the possibility is not ruled out however that they could be configured as separate parts connected to each other.

The damper likewise comprises a stein 36 which is connected to the piston 35, such stein exiting from the cylinder by way of a hole in a cover on a rear side of the cylinder so as to be able to engage an adapted retention seat provided in the housing body 34 at a rear end thereof. There is furthermore a reset spring of the damper, for example arranged coaxially to the stein 36 between the rear cover of the cylinder and the housing body 34, or arranged inside the cylinder 30 between the piston 35 and the front end of the cylinder 30.

In the embodiment shown, the actuating member 30 protrudes at the front from the housing body 34 so as to come into contact with the actuation element 32 in the second connecting lever 16.

Alternatively, the damper can be turned the opposite way, with the cylinder directed toward the rear end of the housing body 34 and with the stein 36 of the piston directed toward the actuation element 32.

From the foregoing description it is evident that the decelerated hinge according to the invention is simple in construction and is suitably configured to provide an effective decelerating action.

Furthermore the hinge according to the present invention has a limited overall space occupation inside the item of furniture, and also a moveable part of reduced height so as to permit its use even on doors of reduced thickness.

Finally, by virtue of the configuration and the specific positioning of the deceleration device, in the hinge according to the invention it has been possible to keep small dimensions and therefore to keep the costs of the damper low, because the damper is used optimally.

The hinge according to the invention is susceptible of modifications and variations, all of which are within the scope of the inventive concept. Moreover, all the details of construction may be substituted by technically equivalent elements.

The disclosures in Italian Patent Application No. 10201800006575 from which this application claims priority are incorporated herein by reference.

The invention claimed is:

1. A decelerated hinge for supporting, so as to oscillate, a door of an item of furniture, which comprises:

a first hinge part which is configured to be affixed to a fixed part of the item of furniture;

a second hinge part which is configured to be affixed to a door of the item of furniture and connected to the first hinge part by way of an articulation system which comprises a plurality of connecting levers and at least five articulation axes;

elastic means that act in a closing direction of the hinge; and a deceleration device which comprises an actuating member that can move linearly according to an axis, wherein said actuating member of the deceleration device is moveably arranged in one connecting lever which is selected from among said plurality of connecting levers of the articulation system, and wherein at least one actuation surface for the actuating member of said deceleration device is provided inside another connecting lever which is adjacent to said one connecting lever of the articulation system, and wherein said actuating member of the deceleration device can rest on at least one contact point of said actuation surface in a neighborhood of a closed position of the hinge, wherein an orthogonal to the actuation surface in said at least one contact point extends substantially parallel to said axis of the actuating member of the deceleration device in said neighborhood of the closed position of the hinge.

2. The decelerated hinge according to claim 1, in which said one connecting lever is a first connecting lever that extends according to a longitudinal axis, wherein the axis of the actuating member of the deceleration device is arranged substantially orthogonal to the longitudinal axis of the first connecting lever.

3. The decelerated hinge according to claim 2, wherein said first lever is connected to said second hinge part by a hinge part articulation axis and in which said first and said another connecting lever, which is a second connecting lever, are mutually connected so as to oscillate by a lever articulation axis, wherein the axis of the actuating member of the deceleration device lies in said first connecting lever at a distance from the lever articulation axis of the, wherein the distance from the axis of the actuating member to the articulation axis which is comprised between ⅕ and ⅗ of the overall distance between the hinge part articulation axis and the lever articulation axis.

4. The decelerated hinge according to claim 3, wherein said actuation surface is provided directly in the second connecting lever.

5. The decelerated hinge according to claim 3, wherein said actuation surface is provided on an actuation element.

6. The decelerated hinge according to claim 5, wherein the actuation element is supported on said second connecting lever, and wherein the actuation element is configured to be movable and adjustable.

7. The decelerated hinge according to claim 6, wherein it has an adjusting/locking member for said actuation element, said adjusting/locking member being actuated by a user by hand or using a tool.

8. The decelerated hinge according to claim 3, wherein said plurality of connecting levers comprise said first connecting lever which has one end connected so as to oscillate with the second hinge part by the hinge part articulation axis and at an opposite end it is connected with said second connecting lever by the lever articulation axis, said second connecting lever at its opposite end being connected so as to oscillate with the first hinge part by a third axis, and in which a third connecting lever is provided which is articulated at one end with the second hinge part by a fourth articulation axis and at an opposite end with a fourth connecting lever by a fifth articulation axis, said fourth connecting lever being articulated with the first hinge part by a sixth articulation axis, the second connecting lever and the third connecting lever being mutually articulated in an intermediate point thereof by a seventh articulation axis.

9. The decelerated hinge according to claim 8, wherein the actuating member is arranged in the first lever of the system and the actuation surface is provided inside the second lever of the system, adjacent to the first lever, or the actuating member is arranged in the second lever of the system and the actuation surface is provided inside the first lever of the system, adjacent to the second lever.

10. The decelerated hinge according to claim 8, wherein the actuating member is arranged in the third lever of the system and the actuation surface is provided inside the fourth lever of the system, adjacent to the third lever, or the actuating member is arranged in the fourth lever of the system and the actuation surface is provided inside the third lever of the system, adjacent to the fourth lever.

11. The decelerated hinge according to claim 2, wherein the deceleration device is moveably supported as a whole in said first connecting lever.

12. The decelerated hinge according to claim 2, wherein the deceleration device has a housing body which is contoured to be fixed in the first connecting lever and which defines a cylindrical seat for sliding and/or guiding a fluid-type linear damper.

13. The decelerated hinge according to claim 1, wherein said actuation surface and/or said actuating member have cam-shaped contact surfaces.

14. The decelerated hinge according to claim 1, wherein said connecting levers are U-shaped in cross-section, said deceleration device being inserted in the U-shaped cross-section of one of said connecting levers.

15. A decelerated hinge for supporting, so as to oscillate, a door of an item of furniture, which comprises:

a first hinge part which is configured to be affixed to a fixed part of the item of furniture;

a second hinge part which is configured to be affixed to a door of the item of furniture and connected to the first hinge part by way of an articulation system which comprises a plurality of connecting levers and at least five articulation axes;

elastic means that act in a closing direction of the hinge; and a deceleration device which comprises an actuating member that can move linearly according to an axis, wherein said actuating member of the deceleration device is moveably arranged in one connecting lever which is selected from among said plurality of connecting levers of the articulation system, and wherein at least one actuation surface for the actuating member of said deceleration device is provided inside another connecting lever which is adjacent to said one connecting lever of the articulation system, in which said one connecting lever is a first connecting lever that extends according to a longitudinal axis, wherein the axis of the actuating member of the deceleration device is arranged substantially orthogonal to the longitudinal axis of the first connecting lever.

* * * * *